United States Patent [19]

Fehr

[11] 4,390,116

[45] Jun. 28, 1983

[54] TOOLBAG SUSPENDERS AND HOLDER

[76] Inventor: Richard B. Fehr, P.O. Box 791, Lafayette, Calif. 94549

[21] Appl. No.: 273,020

[22] Filed: Jun. 12, 1981

[51] Int. Cl.[3] ..... A45F 5/00; A45C 13/30

[52] U.S. Cl. ..... 224/209; 224/258; 224/259

[58] Field of Search ..... 224/216, 215, 209, 211, 224/904, 224, 226, 258, 259; 24/68 AS, 68 E, 19, 72; 2/238; 182/3, 5, 6, 7, 8; 206/373

[56] References Cited

U.S. PATENT DOCUMENTS

| | | | |
|---|---|---|---|
| 356,846 | 2/1887 | Martin | 224/215 X |
| 860,395 | 7/1907 | Lindsey | 224/216 |
| 1,141,941 | 6/1915 | Danz | 224/215 |
| 1,723,147 | 8/1929 | Fourethier | 224/211 X |
| 1,816,262 | 7/1931 | Ritter | 224/259 X |
| 2,008,201 | 7/1935 | Chute | 224/262 |
| 3,038,644 | 6/1962 | Johnson | 224/259 X |
| 3,583,600 | 6/1971 | Scott | 224/209 X |

FOREIGN PATENT DOCUMENTS

| | | | |
|---|---|---|---|
| 7034 | of 1894 | United Kingdom | 224/259 |
| 3220 | of 1912 | United Kingdom | 224/215 |

*Primary Examiner*—Allan N. Shoap

*Attorney, Agent, or Firm*—Harris Zimmerman; Howard Cohen

[57] ABSTRACT

A suspender assembly for supporting a tool bag disposed about the waist includes a pair of strap members, each draped over one of the shoulders. The front portions of the strap members extend generally vertically and are secured to the front portions of the tool bag with adjustable buckles. A cross-strap extends between the front portions of the strap members and is secured therebetween with a quick release buckle. The rear portions of the strap members converge and extend through a double ring assembly, the straps passing through the portion of a first ring which extends through the aperture of a second ring. The double ring assembly is adjustably and slidably disposed along the strap members, and the first ring may be used to hang the toolbag when not in use.

1 Claim, 6 Drawing Figures

TOOLBAG SUSPENDERS AND HOLDER

BACKGROUND OF THE INVENTION

The following patents comprise the closest known prior art:

U.S. Pat. Nos. 191,027, 1,636,766, 2,394,782, 2,718,988, 3,583,600, 3,739,961.

In the construction industry it is a commonplace practice for skilled tradesmen such as carpenters and the like to wear a toolbag about the waist to support and provide ready access to those tools which are used most frequently. Often these toolbags are formed of leather or heavy fabric, and are provided with a plurality of pockets and loops to support the hand tools thereby.

Toolbags known in the prior art are usually supported on the wearer by use of waist buckles, or by means of a separate belt which buckles about the waist. However, a standard tool bag which is loaded with a typical complement of hand tools can be extremely heavy, and the support provided by buckling the belt about the waist may be not only insufficient but also very uncomfortable. Attempts have been made in the prior art to alleviate this problem by providing suspender assemblies to redistribute the load of the toolbag to the shoulders of the wearer. These assemblies are generally characterized as being difficult to adjust for the various loads and load distributions in the toolbag. Furthermore, these prior art suspender assemblies are difficult to store and transport, due to the fact that the straps easily may become entangled with the tools, often causing the toolbag to spill its contents.

SUMMARY OF THE PRESENT INVENTION

The present invention generally comprises a suspenders arrangement for toolbags and the like which provides a means for supporting a trade worker's toolbag on the shoulders of the wearer. The suspender arrangement of the present invention is easily fastened to the wearer for quick removal and replacement, and is also provided with adjustment features which are disposed for convenient access by the wearer. Also, the invention easily may be hung from a hook, or hoisted or lowered without spilling the contents of the toolbag supported thereby.

The suspender assembly for supporting a tool bag disposed about the waist includes a pair of strip members, each draped over one of the shoulders. The front portions of the strap members extend generally vertically and terminate medially at junctions where they are joined to adjustable buckles. Front straps extend downwardly from the buckles, through slots in the tool bags, and back upwardly through the buckles. A cross-strap extends between the front portions of the strap members and is secured therebetween with a quick release buckle. The rear portions of the strap members converge and extend through a double ring assembly, the straps passing through the portion of a first ring which extends through the aperture of a second ring. The double ring assembly is adjustably and slidably disposed along the strap members, and the first ring may be used to hang the toolbag when not in use.

A BRIEF DESCRIPTION OF THE DRAWING

DESCRIPTION OF THE PREFERRED EMBODIMENT

Figure 1:
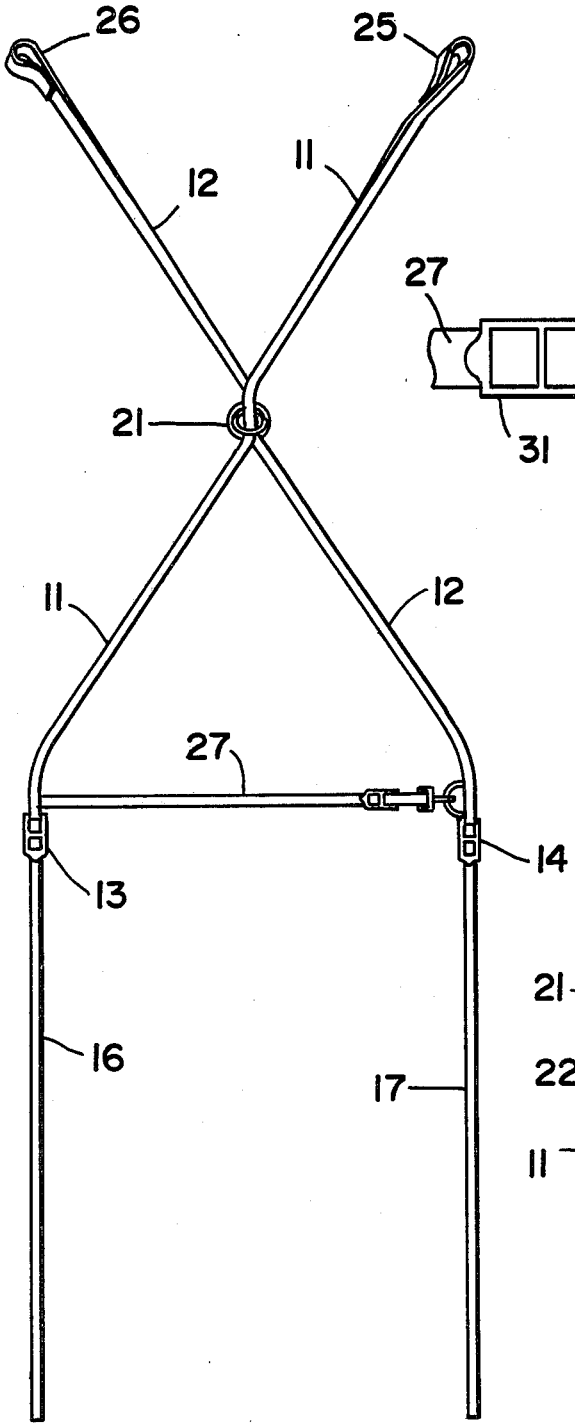
FIG. 1 is a plan view of the toolbag suspender assembly of the present invention.
Figure 2:
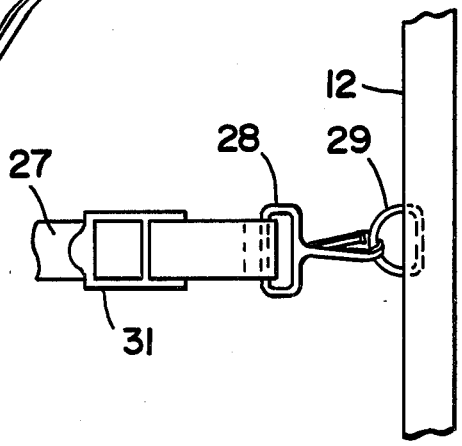
FIG. 2 is an enlarged detail view of the front buckle of the toolbag suspender assembly of the present invention.
Figure 4:
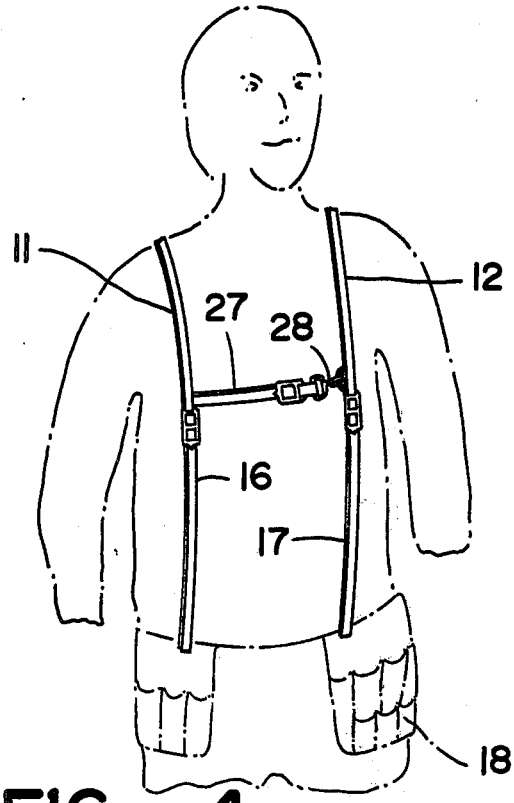
FIG. 4 is a perspective view of a toolbag suspender assembly of the present invention, shown in use with a typical toolbag.

The present invention generally comprises a suspender arrangement for suspending from the shoulders a worker's toolbag which extends about the waist of the worker. With reference to FIG. 1, the suspender assembly includes a pair of strap members 11 and 12, each draped over one of the shoulders of a worker, as shown in FIG. 4. The medial front ends of the strap members 11 and 12 are joined to adjustable buckle members 13 and 14 respectively. Lower front straps 16 and 17 extend downwardly from the buckles 13 and 14, and pass through slots or loops in respective confronting side portions of a worker's toolbag 18. The distal ends of the straps 16 and 17 return upwardly from the toolbag 18 and are adjustably retained by the respective buckles 13 and 14.

Figure 3:
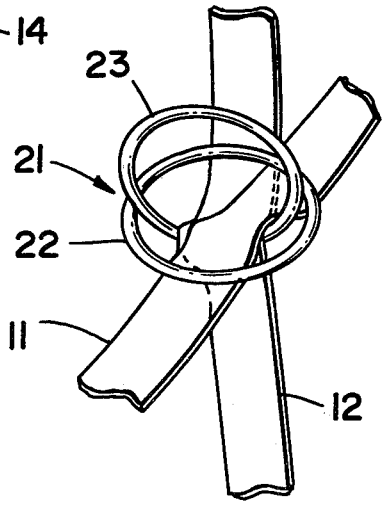
FIG. 3 is an enlarged detailed view of the double ring detent assembly of the present invention.
Figure 5:
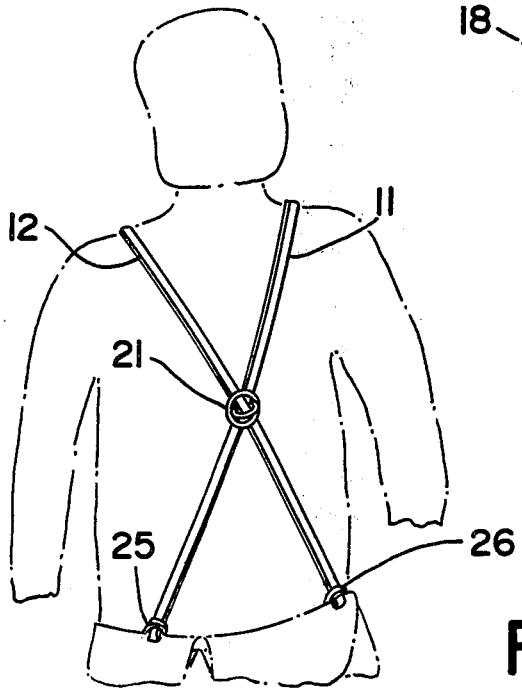
FIG. 5 is a perspective view of the rear portion of the present invention as depicted in FIG. 4.

The medial back portions of the strap members 11 and 12 converge to pass through a double ring detent assembly 21, as shown in FIGS. 3 and 5. The assembly 21 includes a pair of circular rings 22 and 23, each of the rings being unbroken and not linked to the other. The straps 11 and 12 pass through the aperture of the ring 22, thence through the aperture of the ring 23, and then back through the aperture of the ring 22. The two rings 22 and 23 may be brought into conjunction, as shown in detail in FIG. 3, so that the ring 23 is disposed transversely with respect to the ring 22 with a portion of the former extending through the aperture of the latter. In this configuration the rings act as a detent to hold the straps 11 and 12 in their relative, adjacent positions. The angular bends which the straps undergo in a relatively short distance when passing through the ring assembly 21, as configured in FIG. 3, effectively locks the straps 11 and 12 together.

It may be noted that the straps 11 and 12 are tangent as they pass over each other and through the double ring assembly 21, and the straps cross at that point. The distal back portion of the straps 11 and 12 extends downwardly to the opposite sides as the respective front portions thereof. The distal back ends 25 and 26 of the straps 11 and 12, respectively, are sewn to provide loops. The strap portion extending from each loop end passes through a respective slot in laterally opposed back portions of the tool belt and is passed back through its respective loop to then extend upwardly toward the double ring detent assembly.

The strap assembly also includes a cross strap 27 extending generally transversely between the front medial portions of the straps 11 and 12. One end of the strap 27 is sewn to the strap 11 adjacent to the buckle 13, while the other end of the strap 27 is joined by a sliding buckle 31 to a snap hook 28. A D-ring 29 is secured to the strap 12 adjacent to the buckle 14, and is disposed to be engaged by the snap hook 28. The strap 27 prevents the straps 11 and 12 from diverging outwardly, so that the upper portions of the straps 11 and 12 will not slide from the shoulders of the individual using the suspender assembly.

Figure 6:
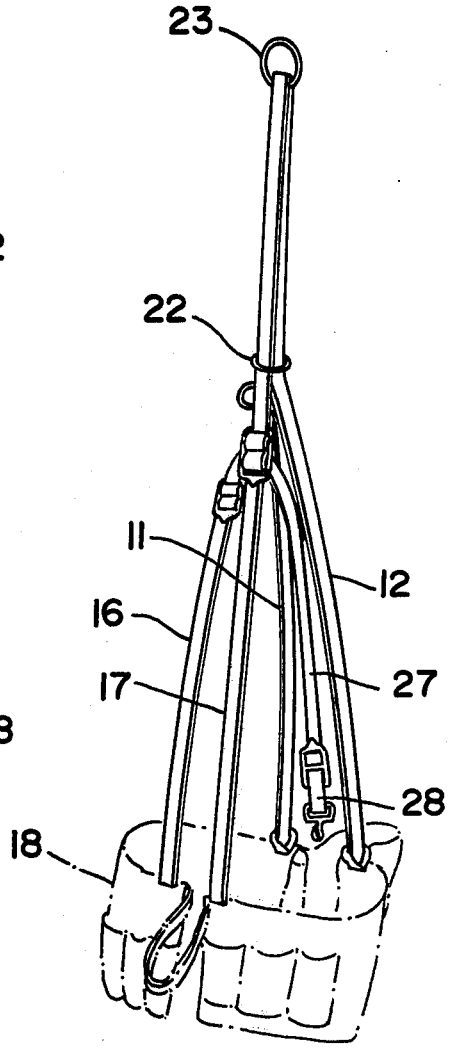
FIG. 6 is a perspective view of the toolbag suspender assembly of the present invention, shown in its hanging disposition.

A salient feature of the double ring assembly 21 is that the ring 23 may also be employed for supporting the entire suspender assembly and toolbag when it is not being worn. As shown in FIG. 6, the entire assembly may be supported by grasping or otherwise supporting the ring 23, with the rest of the assembly hanging therefrom. In this circumstance, the ring 22 slides downwardly by virtue of its own weight, causing the front and rear portions of the straps 11 and 12 to become gathered in closely adjacent fashion and they extend from the ring 23 downwardly through the ring 22. In this disposition the suspender assembly easily may be hung from a hook or nail passing through the ring 23 to support the assembly while it is not being worn. Furthermore, a rope or the like may be passed through the ring 23 to hoist or lower the entire assembly, a task which often must be performed on construction projects and the like. The manner in which the straps 11 and 12 are gathered by the ring 22 and supported by the ring 23 at the natural balance point maintains the toolbag in a generally horizontal configuration and prevents the toolbag from tipping spontaneously and spilling its contents.

When it is desired to replace the assembly on the person of the worker, the worker may lift the entire assembly by grasping the ring 23 with one hand. The strap assembly is first re-configured by grasping the straps 11 and 12 with the other hand, and simultaneously sliding the ring 22 upwardly so that it impinges upon the ring 23. By continuing to hold the straps 11 and 12, the rings 22 and 23 may be slidably translated by pulling on ring 23. The straps 11 and 12 are thus freed to be placed over the shoulders of the worker. The snap hook 28 is then engaged with the D-ring 29 to secure the cross strap 27 and to secure the entire assembly to the worker.

It may be appreciated that the placement of the double ring assembly 21 determines the point at which the straps 11 and 12 intersect at the back of the worker. The placement of the assembly 21 easily may be adjusted by holding straps 11 and 12 and sliding the ring 23 to the point which is most comfortable to the wearer.

I claim:

1. A suspender assembly for supporting a tool bag disposed about the waist of an individual, comprising; a pair of strap members adapted to be draped over the shoulders of the individual, said strap members including front portions extending generally vertically and joined to confronting, adjacent front portions of the tool bag, said strap members including back portions which cross and are joined to opposite adjacent back portions of the tool bag, double ring detent assembly means for adjustably determining the point of intersection of said back portions and for suspending the tool bag on said strap members in a generally horizontal, balanced fashion, said double ring detent assembly means including a first ring and a second ring of similar diameters, said strap members passing into and out of the same end of the aperture of said first ring in half-loop fashion, said second ring circumscribing both of said strap members at the half-loop portions in slidable fashion and adjustably defining said point of intersection, said first ring being slidably positionable along said strap members from a detent position in which said rings are abutting and said strap members are bound therebetween at said point of intersection to a non-detent position in which said first ring is spaced apart and disengaged from said second ring and said strap members are freely translated through said second ring to permit the tool bag to hang therefrom in balanced fashion.

* * * * *